US010681448B2

(12) United States Patent
Mason

(10) Patent No.: US 10,681,448 B2
(45) Date of Patent: Jun. 9, 2020

(54) STORAGE POUCH FOR EARBUDS

(71) Applicant: Barry R. Mason, Las Vegas, NV (US)

(72) Inventor: Barry R. Mason, Las Vegas, NV (US)

( * ) Notice: Subject to any disclaimer, the term of this patent is extended or adjusted under 35 U.S.C. 154(b) by 110 days.

(21) Appl. No.: 16/037,327

(22) Filed: Jul. 17, 2018

(65) Prior Publication Data

US 2020/0029148 A1 Jan. 23, 2020

(51) Int. Cl.

| | |
|---|---|
| ***H04R 1/10*** | (2006.01) |
| ***A45C 11/00*** | (2006.01) |
| ***A45C 13/00*** | (2006.01) |
| ***A45C 13/02*** | (2006.01) |

(52) U.S. Cl.

CPC ..... *H04R 1/1033* (2013.01); *A45C 11/00* (2013.01); *A45C 13/02* (2013.01); *A45C 2011/001* (2013.01); *B65H 2701/3919* (2013.01); *H04R 1/1016* (2013.01)

(58) Field of Classification Search

CPC .. H04R 1/1016; H04R 1/1033; H04R 1/1041; H04R 1/1066; H04R 3/12; H04R 2420/09; H01B 7/06; H02G 11/02; H01R 31/02

USPC ..... 206/37, 320, 702, 720, 724, 725; 381/384; 455/575.8; D9/721; D14/223

See application file for complete search history.

(56) References Cited

U.S. PATENT DOCUMENTS

| | | | | |
|---|---|---|---|---|
| 2,823,723 | A * | 2/1958 | Cohn | A45C 11/323 383/43 |
| 5,887,720 | A * | 3/1999 | Lin | H04R 1/10 206/38 |
| 6,026,961 | A * | 2/2000 | McCarthy | G06F 1/1628 206/320 |
| D604,501 | S * | 11/2009 | Lee | D3/201 |
| 7,610,661 | B2 * | 11/2009 | Sween | B65H 75/06 24/129 R |
| 7,661,623 | B2 * | 2/2010 | Peng | B65H 75/04 242/118.4 |
| 8,265,325 | B2 * | 9/2012 | Park | H04R 1/1033 381/370 |
| 8,479,922 | B2 * | 7/2013 | Kennedy | H04B 15/00 206/720 |
| 8,714,358 | B2 * | 5/2014 | Debitzky | H04R 1/1033 206/409 |
| 9,731,886 | B2 * | 8/2017 | Chang | B65D 81/18 |
| 10,117,485 | B2 * | 11/2018 | Solland | B65H 75/4465 |
| 10,182,632 | B2 * | 1/2019 | Kearsley | A45C 11/321 |
| 10,397,683 | B2 * | 8/2019 | LeBlanc | H04R 1/1041 |
| 2004/0198470 | A1 * | 10/2004 | Dyer | A45C 11/00 455/575.1 |
| 2005/0148313 | A1 * | 7/2005 | Chee | B65H 75/143 455/347 |
| 2012/0128193 | A1 * | 5/2012 | Stevinson | H04R 1/1033 381/384 |

(Continued)

*Primary Examiner* — Joshua E Rodden

(57) ABSTRACT

A device including a container pouch implement, wherein said container pouch implement is configured to be operable for storing an earphone or an earbud paraphernalia, at least two container constituent, wherein each of said at least two container constituents is configured to receive an earbud, a tapered stem portion, wherein said tapered stem portion is configured to connect said at least two container constituents, and an attachment stem portion, wherein said attachment stem portion is configured to engage said at least two container constituents with said container pouch implement.

16 Claims, 7 Drawing Sheets

(56) References Cited

U.S. PATENT DOCUMENTS

| | | | | |
|---|---|---|---|---|
| 2013/0148839 | A1* | 6/2013 | Stevinson | H04R 1/1033 381/384 |
| 2013/0161339 | A1* | 6/2013 | Stein | A45D 40/18 220/694 |
| 2014/0360898 | A1* | 12/2014 | Kantor | A45C 11/00 206/216 |
| 2016/0050481 | A1* | 2/2016 | Moats | H04R 1/1033 381/384 |
| 2016/0058144 | A1* | 3/2016 | Tebo | B65H 75/406 206/38 |
| 2016/0295312 | A1* | 10/2016 | Merenda | A45C 11/00 |
| 2017/0142853 | A1* | 5/2017 | Li | A45C 11/00 |
| 2017/0195760 | A1* | 7/2017 | Tang | H04R 1/1033 |
| 2017/0210591 | A1* | 7/2017 | Kennedy | B65H 75/406 |
| 2019/0141431 | A1* | 5/2019 | Putnam, Jr. | H04R 1/1016 |
| 2020/0029148 | A1* | 1/2020 | Mason | H04R 1/1033 |

* cited by examiner

STORAGE POUCH FOR EARBUDS

CROSS-REFERENCE TO RELATED APPLICATIONS

Not applicable.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to protective cases for portable electronic devices. More particularly, certain embodiments of the invention relate to a protective container pouch for earphones and the devices with which they are used.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. In general, headphones may include an electrical jack coupled to one or more earbuds with an electrical cable. A "Y" topology having three loose ends may represent a headphone system with two earbuds. The use of portable music players, smartphones, or tablet computers may bring along a corresponding use of headphones with earbuds. In general, one can expect that users may store the headphone in pouches, pockets, purses, bags, etc. when not in use. In the process, the headphone cords may become twisted and/or tangled creating knots and loops. Typically, tangled cords may be difficult to untangle. Twisted and/or tangled cables may lead to the degradation of the integrity of the headphones due to damages to the earbuds and the cable/s.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a class of proposed solution may involve a spring-loaded roller mechanism that the user may deploy to roll-up the electrical cable for storage. Other cord management solutions may require placement of the cord onto a pulley. A typical spring-loaded roller may be quite bulky compared to the balance of the earphone system. Other solutions require the use of a reel-type earphone housing wherein the cable/cord is pulled out from both ends of a cable housing. In most cases, mechanized assembly may create considerable added bulk in storage and may be complex to use, which may constrain the end user.

In view of the foregoing, it is clear that these traditional techniques are not satisfactory and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
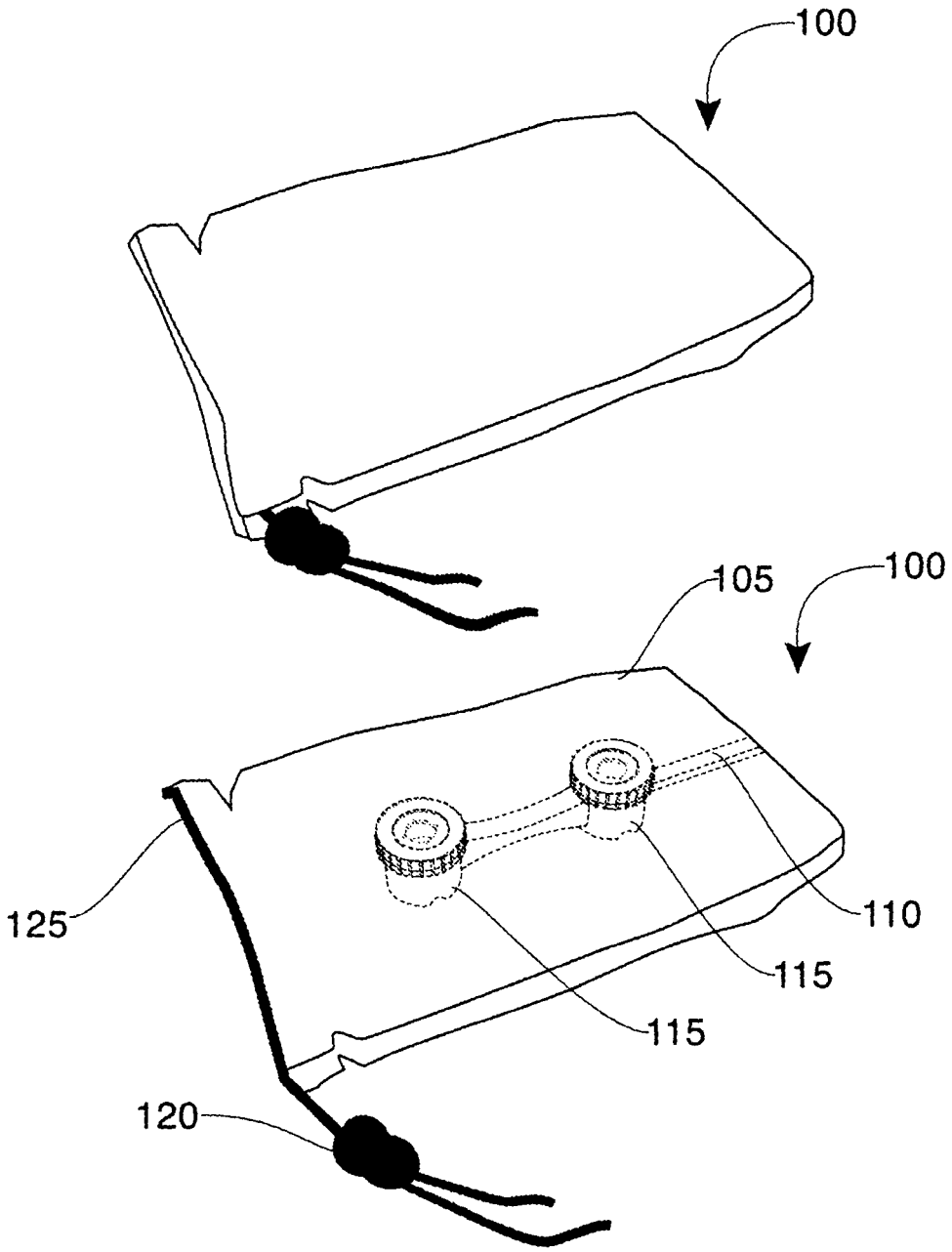
FIG. 1 is an illustration of an exemplary container pouch implement, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially" ] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F. 3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of. or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising" And "contain" and variations of them—Such terms are open-ended and mean "including but not limited to". When employed in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn. 112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

All terms of exemplary language (e.g., including, without limitation, "such as", "like", "for example", "for instance", "similar to", etc.) are not exclusive of any other, potentially, unrelated, types of examples; thus, implicitly mean "by way of example, and not limitation . . . ", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary, a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Some embodiments of the present invention and variations thereof, relate to a protective storage container pouch implement for earphones/earbuds and the devices with which they are used. In one embodiment of the present invention, a protective storage container pouch implement may store earbud paraphernalia commonly used with popular portable electronic devices such as smartphones, computerized tablets and iPods. The storage container pouch implement may include a protective hosting case, into which said earbud paraphernalia is securely inserted when not in use and protects earbuds from accidental damages, such as but not limited to unintentional impact. The container pouch implement may, but not limited to, prevent accidental loss of earbuds by providing secure storage in its sealable pouch, provides a clean and contained storing environment for earbuds, reduces the risk of exposing earbuds to dirt, grime and other undesirable elements while stored in the containers, prevent exposure of earbuds to germs and bacteria of the open environment, protect earbuds users from a common source of ear infection, etc.

In an embodiment, a storage container pouch device may include a retractable stem portion about which the earbud paraphernalia's wire may be conveniently wrapped for secure storage. The earbud paraphernalia may be securely inserted and stored within the container constituent upon this same stem. The earbud cable/cord may be wrapped around the stem portion, and the earbud may be inserted inside storing container/cylinder constituents that extend from this stem portion. Foam material in the shape of discs may be included inside the containers/cylinders for safe storage of the earbuds. A cylindrical endcap segment may be unthreaded that seals each container constituent to remove and clean the foam discs. The entire stem portion may be enclosed within the container pouch implement, the interior base hem of which attaches by threading upon an extension to the stem portion. The container pouch implement may be made of a polyester fabric material, and a drawstring may allow the pouch and its contents including the stem, earbuds, cable and the entire electronic device to be protectively sealed. The stem portion may be produced of various materials, such as but not limited polyvinyl chloride (PVC) and high-density polyethylene (HDPE), and can be made in various sizes and shapes.

In additional embodiments, the protective storage cylindrical container constituent connected to the stem may be of various shapes and sizes. The foam material or foam discs within the container constituent may be made of various substances, such as but not limited to polyurethane (PU) and polyethylene (PE). The stem portion may attach within the storage pouch by various means such as stitching, snap, button and spring-loaded tab. The stem may be attached within the storage container pouch implement in retractable format, with use of implements such as but not limited to elasticized strap, sliding track, and withdrawing string sealed behind an interior wall of the storage container pouch implement. The storage container pouch implement may be made of various materials, such as but not limited to polyester, cotton, vinyl and any blend of these and other materials. The storage container pouch implement may or may not be in mesh format. The storage container pouch implement may be made in various sizes and shapes. The storage container pouch may be sealed by various means and appendages, such as but not limited to drawstring, zipper and folding flap. The storage container pouch may be opened and sealable from a wall plane instead of a horizontal end-seam. In such variation, the hosting stem may or may not be retractable. In an alternative embodiment, the earbuds/earphones may be permanently attached within the storage container pouch. In such variations, the earbud/earphone cables may or may not be stored within a sealed compartment, and may release the cables by various means, such as but not limited to spring-coil.

In other embodiments, the base stem may be made of polyvinyl chloride (PVC), and may measure approximately four inches in length by one half-inch in width (4"×½"). At one (1) endpoint of the stem portion, which may extend vertically, is a cylindrical container, measuring approximately one inch in diameter by one inch in height (1"×1"). A distance of approximately one inch (1") on the stem is between this container and a second container of the same size. The diameter of the stem portion in this area between the two (2) cylindrical extensions is generally tapered to an approximate quarter-inch (¼") depth. The container constituents may feature concave indentations of approximate three-quarter inch (¾") depth. Two (2) polyurethane (PU) foam pieces in disc format and open center may be included within each of the concave indentations, and for securement of the earbud units hosted by the container constituents. Caps may fit an end portion of the container constituents by threaded rotation, and for securement of the PU foam. Each endcap may feature a center hole section for accepting an earbud. The storage container pouch implement for containment of the stem, hosted earbuds and wiring, and of the e-device with which the earbuds may be used may be made of a polyester material that flat-measures approximately six inches in length by five inches in width, in a tight-mesh format. The open end of the storage container pouch implement may be sealable by a drawstring sewn within the hem. The stem portion may be durably sewn directly to the interior short side hem of the storage container pouch implement. Alternatively, the stem portion would feature two sealed container constituents without a pouch.

In some other embodiments, in use, in a first step, a drawstring may be loosen to open the storage container pouch implement and fold the pouch downward to fully expose the interior stem. In a second step, the earbud's wire/cord/cable may be wound about the tapered section of the stem portion between the container constituents. In a third step, the earbuds may be inserted directly within the container constituents. In a fourth step, the storage container pouch implement may be pulled up over the stem portion, and then seal the storage container pouch implement after inserting the electronic device including but not limited to a smartphone, music player, etc. In a fifth step, the drawstring may then be pulled to close the storage container pouch implement. To access the contents later for use, the user may fold the storage container pouch implement downward to expose the stem, then remove the earbuds from the hosting cylinder constituents, then unwind the earbuds wire/cord/cable.

In some embodiments, the container pouch device may comprise a compact storage and organizing accessory for earbuds that may protect the earbuds from damage, keeps the earbuds clean, ensures portability, and facilitates easy use. The implement may further comprise a tightknit mesh storage pouch with drawstring and securing an earbud-hosting stem to the inner hem of the pouch. Two container constituents may project from one surface side of the stem portion. The container constituents may host the ear-insert portion of the earphone including earbuds. Within each container constituent are two foam discs that may secure and cushion the earbuds. The bottom of each container constituent may feature a channel. The plug of the earbuds may be stored within one of the channel constituents. The tapered portion of the stem portion between the container constituents may host the wrapped wire/cord/cable of the earbud. The container constituents may feature removable endcaps that may allow access to the foam discs. Each endcap may feature a hole in its center section configured to allow the earbuds to pass. The foam discs may feature specially-designed holes that allow the earbuds to be easily inserted, but the flaps of the hole section may push against the earbuds to keep the earbuds in place. The earbuds may be secured and typically will not accidently fall out. The foam discs may also cushion the earbuds from impact.

The present invention will now be described in detail with reference to embodiments thereof as illustrated in the accompanying drawings.

FIG. 1 is an illustration of an exemplary storage container pouch implement 100, in accordance with an embodiment of the present invention, with a see-thru view of the interior of the storage container pouch implement 100 in (B), showing a durable interior hem 105, a drawstring hem 125, an exposed drawstring 120, an attachment stem portion 110, and two container constituents 115. In the present embodiment, the attachment stem portion 110 may engage the two container constituents 115 to the storage container pouch implement 100. The drawstring hem 125 may receive a drawstring 120.

Figure 2:
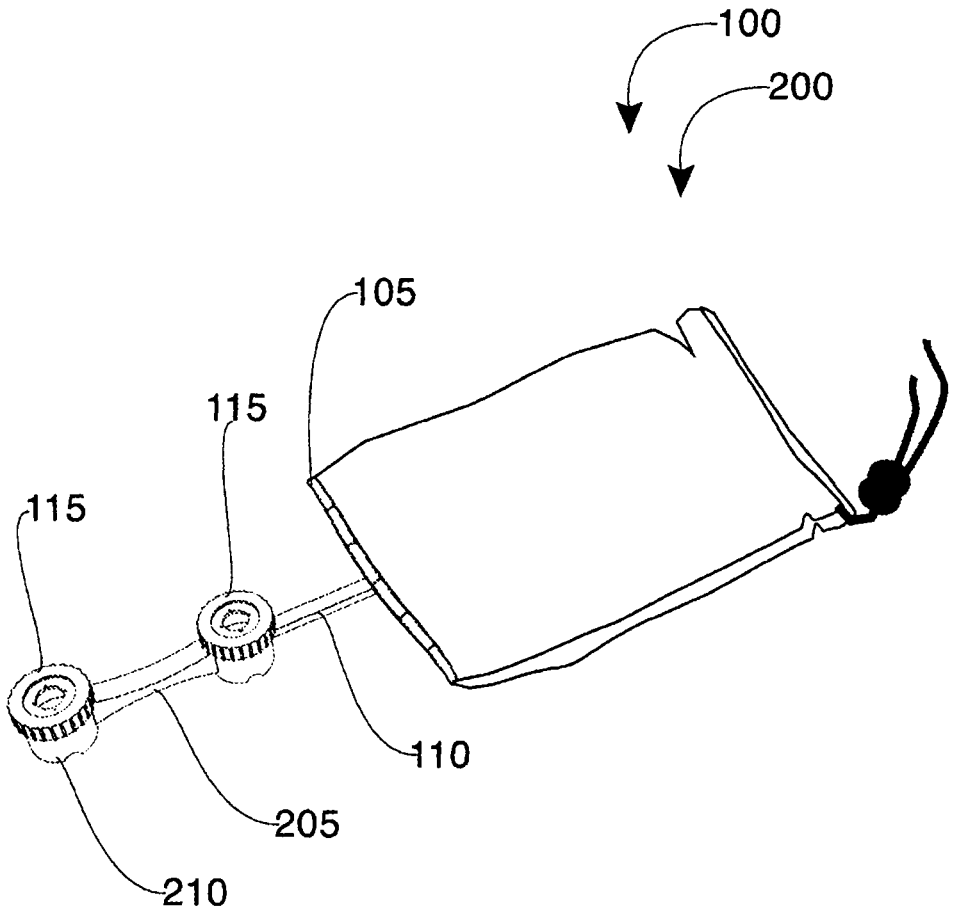
FIG. 2 is an illustration of an exemplary container pouch implement turned inside out, in accordance with an embodiment of the present invention.

FIG. 2 is an illustration of an exemplary storage container pouch implement 100 turned inside out, in accordance with an embodiment of the present invention. The exposed contents depict two container constituents 115 which may be operable for receiving an earbud, a concave channel 210 which may be operable for receiving a plug of the earbud, and a tapered stem portion 205 which may be operable for receiving a wire/cord connecting the earbud and the plug. A first end segment of the attachment stem portion 110 may attach to the durable interior hem 105 of the storage container pouch implement 100. The other segment of the attachment stem portion 110 may attach to one of the two container constituents 115 and the tapered stem portion 205 may connect the two container constituents 115. The concave channel 210 being disposed under each of the container constituents 115 may be operable for receiving the plug of the earbud.

Figure 3:
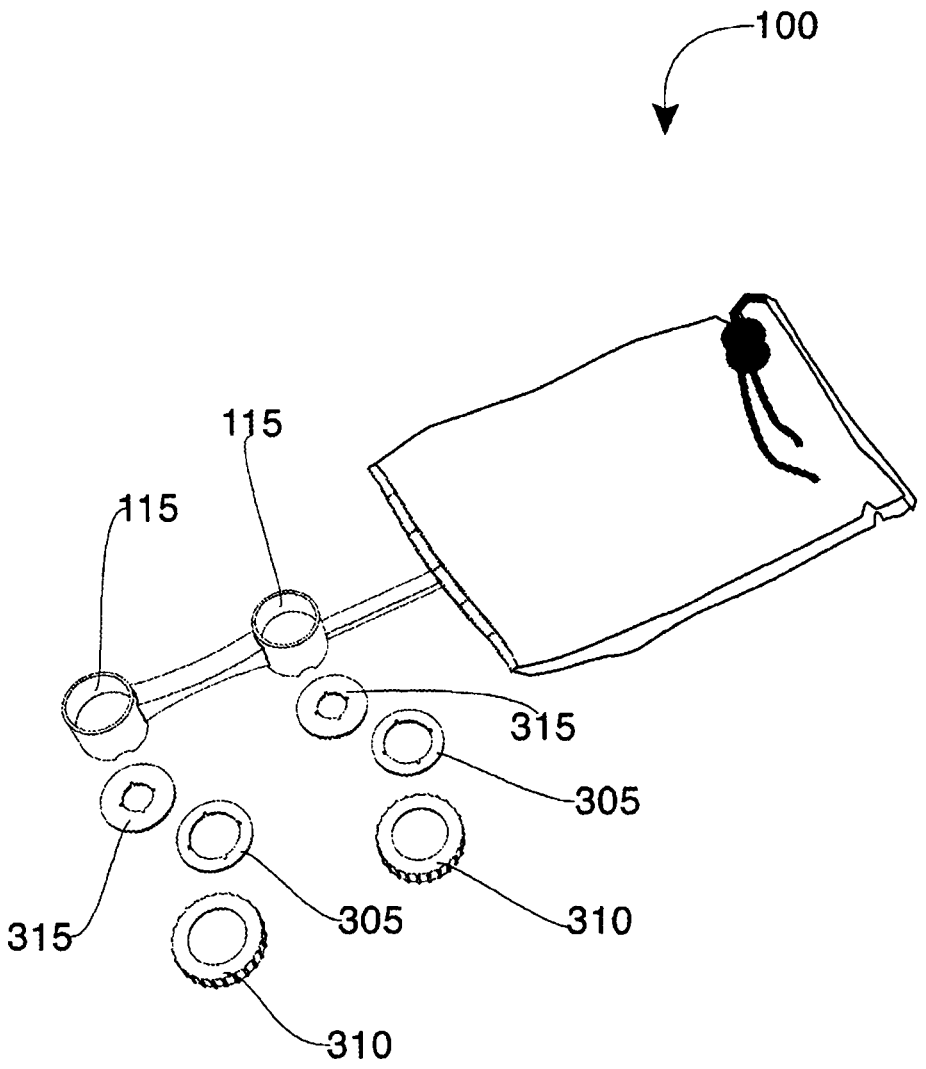
FIG. 3 is an illustration of an exemplary parts of a container, in accordance with an embodiment of the present invention.

FIG. 3 is an illustration of an exemplary storage container pouch implement 100 turned inside out and showing different parts of the container constituents 115, in accordance with an embodiment of the present invention. Depicted are two bottom foam discs 315, two top foam discs 305, and two endcaps 310. The top foam discs may include special cut holes 320 that may allow earbuds to slip in and be secured in place. The bottom foam discs may feature this special cut, but to a lesser degree. The two endcaps 310 may comprise removable endcaps, wherein the two endcaps 310 may secure the foam discs in place and may allow access to the foam discs for cleaning. Additionally, each endcap 310 may feature a hole in its center section configured to allow earbuds to pass.

Figure 4:
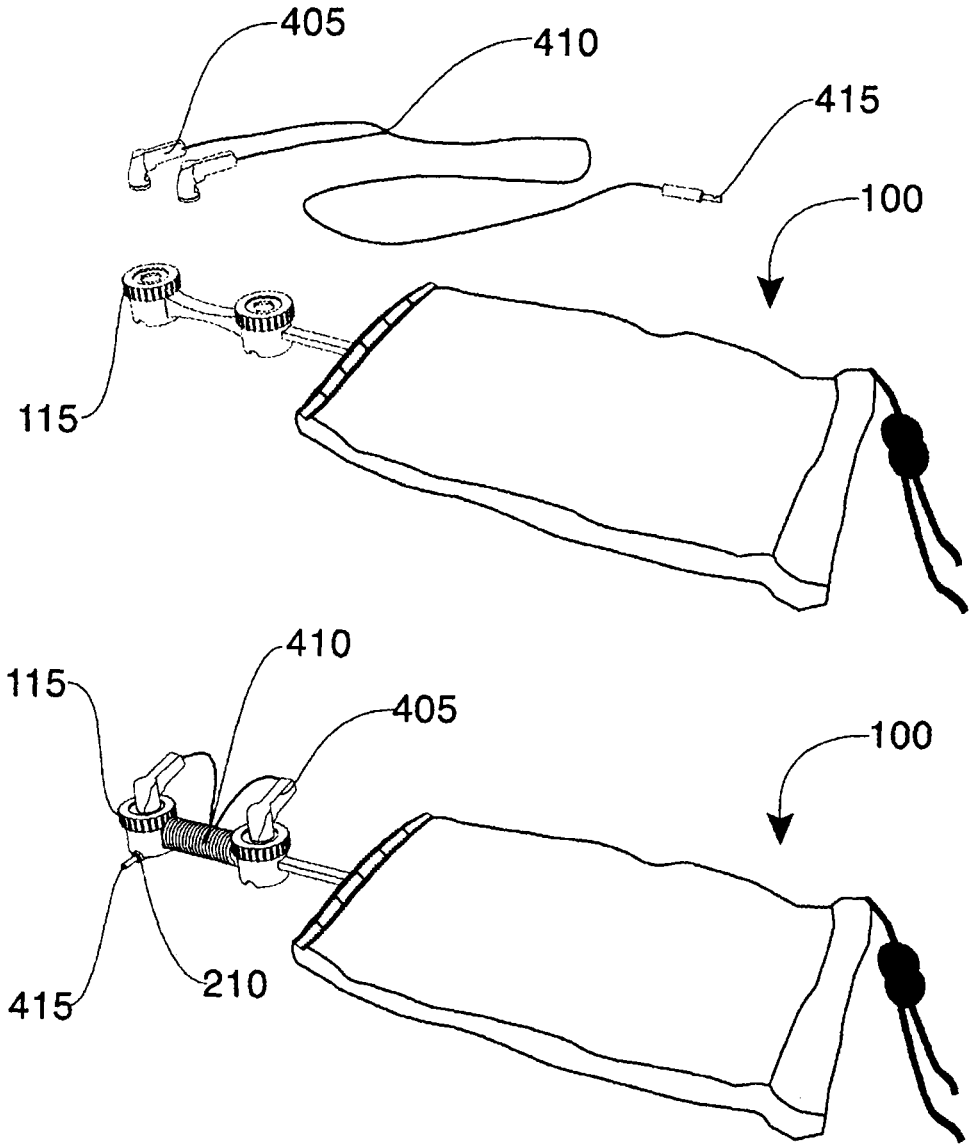
FIG. 4 is an illustration of an exemplary use of a container, in accordance with an embodiment of the present invention.

FIG. 4 is an illustration of an exemplary use of a storage container pouch implement 100, in accordance with an embodiment of the present invention. In the present embodiment shown, a headphone is depicted including earbuds 405, plug 415, and wire/cord 410 connecting the earbuds 405 and the plug 415. In use, each earbud 405 may be secured in each of the container constituents 115 as shown in (B), the wire/cord 410 wrapped around the tapered stem portion 205, and the plug 415 may be secured in a concave channel 210.

Figure 5:
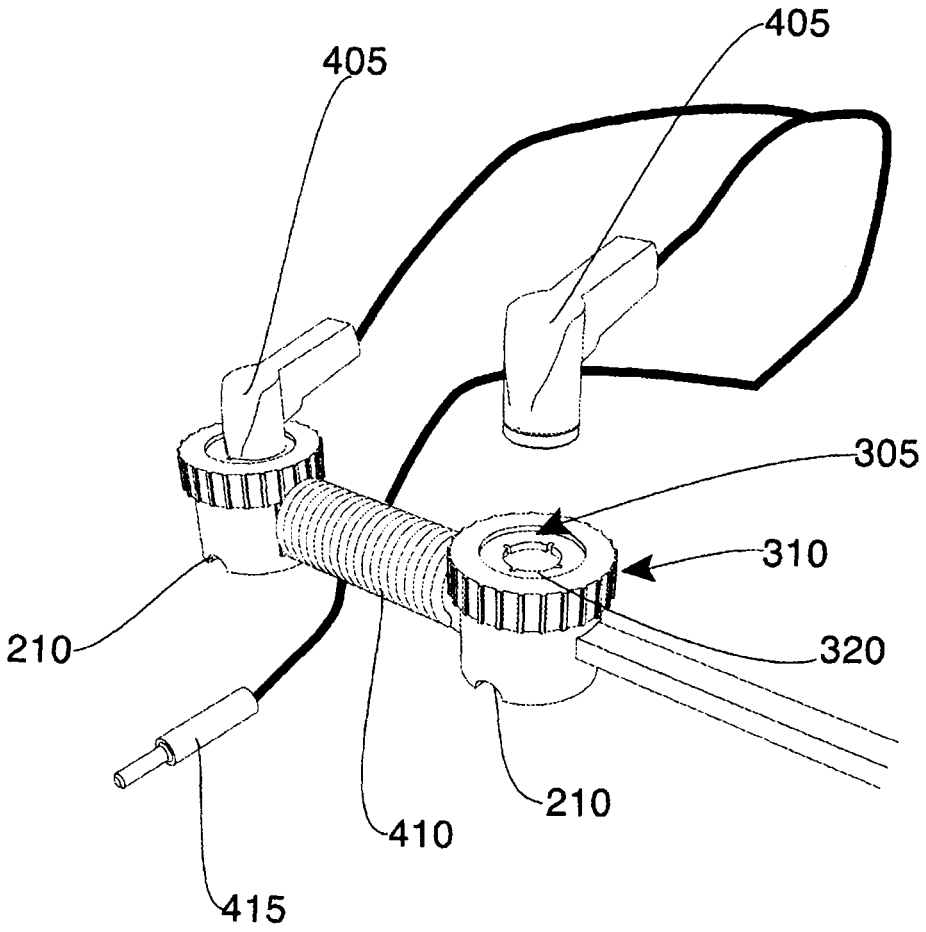
FIG. 5 is an illustration of an exemplary use of a container, in accordance with an embodiment of the present invention.

FIG. 5 is an illustration of an exemplary use of container constituents 115, in accordance with an embodiment of the present invention. In the present embodiment, the top foam disc and endcap is shown installed in the container constituents 115, an earbud 405 may be secured in one of the container constituents 115, the wire/cord 410 wrapped around the tapered stem portion 205, and the plug 415 may be ready for securement in one of the concave channels 210.

Figure 6:
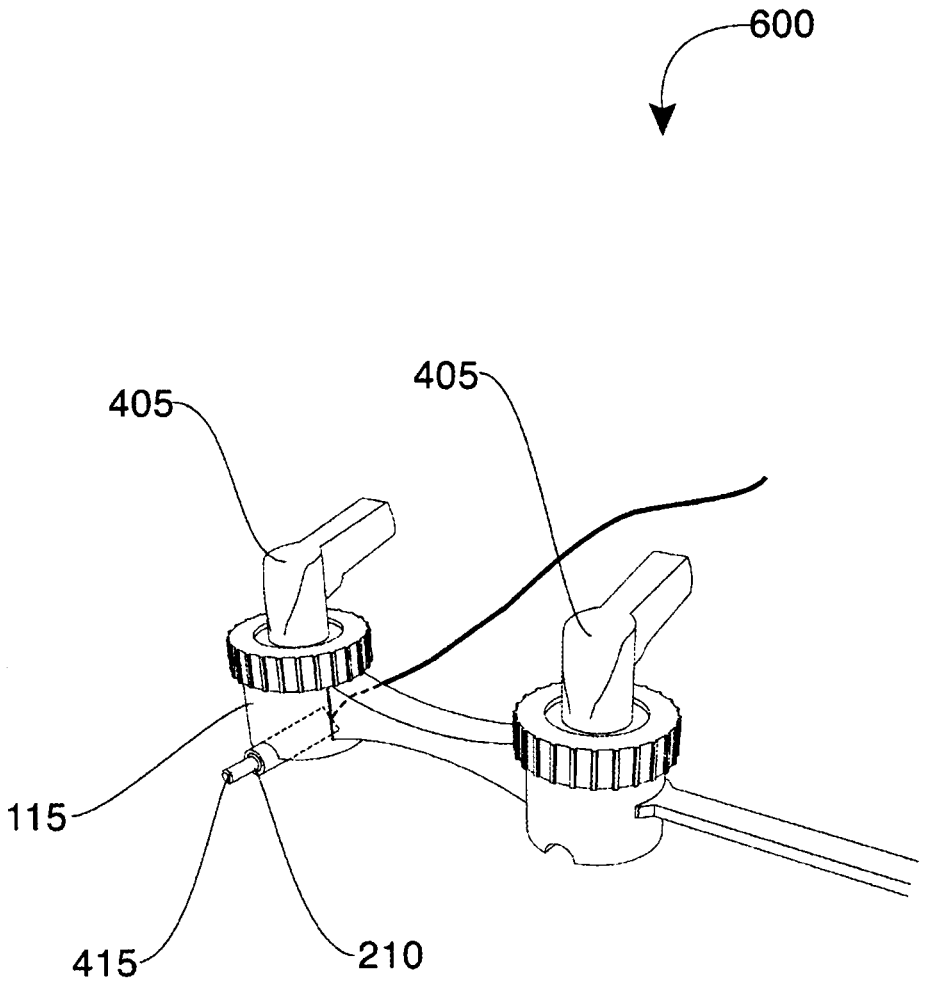
FIG. 6 is an illustration of an exemplary use of a container, in accordance with an embodiment of the present invention.

FIG. 6 is an illustration of an exemplary use of container constituents 115, in accordance with an embodiment of the present invention. A see-thru view is depicted where the earbuds 405 may be secured in the container constituents 115 and the plug 415 may be secured in one of the concave channels 210.

Figure 7:
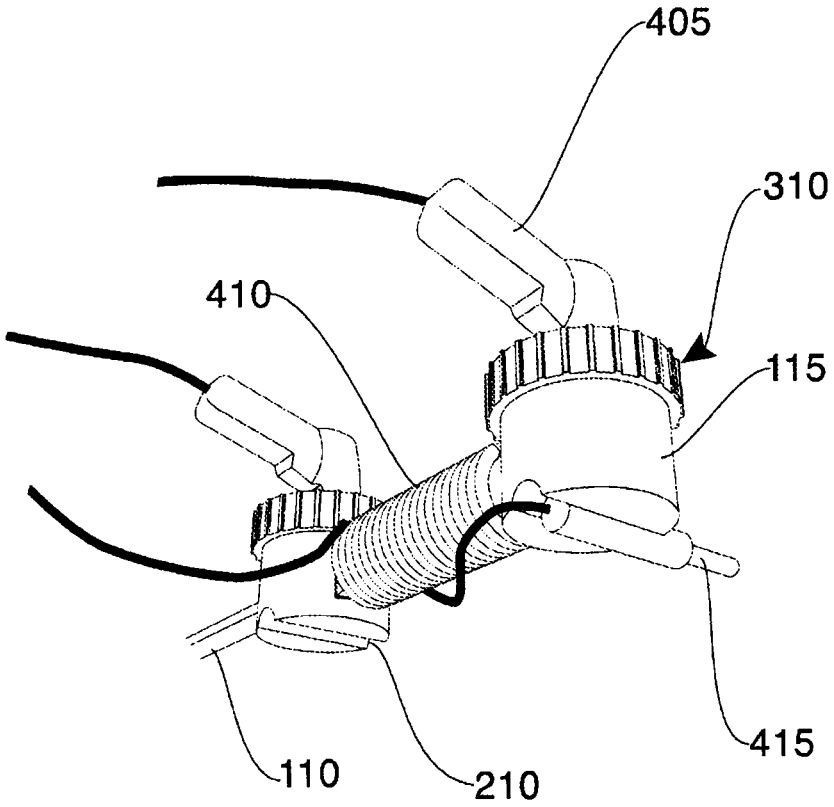
FIG. 7 is an illustration of an exemplary use of a container, in accordance with an embodiment of the present invention.

FIG. 7 is an illustration of an exemplary use of container constituents 115, in accordance with an embodiment of the present invention. An underside view of container constituents 115 may be depicted where the plug 415 may be secured in one of the concave channels 210. Each earbud 405 may be secured in each of the container constituents 115 and the wire/cord 410 wrapped around the tapered stem portion.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any $3_{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a protective storage container pouch implement for storing earbud paraphernalia commonly used with popular portable electronic devices such as smartphones, computerized tablets and iPods according to the present invention will be apparent to those skilled in the art. Various aspects of the invention have been described above by way of illustration, and the specific embodiments disclosed are not intended to limit the invention to the particular forms disclosed. The particular implementation of the protective storage container pouch implement for storing earbud paraphernalia commonly used with popular portable electronic devices such as smartphones, computerized tablets and iPods may vary depending upon the particular context or application. By way of example, and not limitation, the protective storage container pouch implement described in the foregoing were principally directed to storing earbud paraphernalia commonly used with popular portable electronic devices such as smartphones, computerized tablets and iPods implementations; however, similar techniques may instead be applied to storing smartphones or mobile phone, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device comprising:

a container pouch implement, wherein said container pouch implement is configured to be operable for storing an earphone or an earbud paraphernalia;

at least two container constituent, wherein each of said at least two container constituents is configured to receive an earbud;

a tapered stem portion, wherein said tapered stem portion is configured to connect said at least two container constituents; and an attachment stem portion, wherein said attachment stem portion is configured to engage said at least two container constituents with said container pouch implement; and wherein said container pouch implement further comprises a closed end portion having an interior hem segment, wherein said interior hem is configured to seal said closed end portion, and wherein said interior hem segment is attached to said attachment stem portion.

2. The device of claim 1, in which said container pouch implement comprises the closed end portion and an open end portion, wherein said open end portion comprises a hem segment that is configured to receive a drawstring.

3. The device of claim 1, in which said tapered stem portion is further configured to accept an earbud wire or cord.

4. The device of claim 3, in which each of said at least two container constituents comprises a concave channel segment that is configured to receive an earbud plug.

5. The device of claim 2, further comprising a drawstring mechanism disposed in said hem segment, wherein said drawstring mechanism is configured to adjustable seal said open end portion of said container pouch implement.

6. The device of claim 5, further comprising at least two top foam discs, each of said at least two top foam discs being disposed in each of said container constituents, and each of said at least two top foam discs having cut holes, wherein said cut holes are configured to allow earbud to slip in and be secured in place.

7. The device of claim 6, further comprising at least two bottom foam discs, each of said at least two bottom foam discs being disposed in each of said container constituents, and each of said at least two bottom foam discs having cut holes.

8. The device of claim 7, further comprising at least two endcaps, wherein each of said at least two endcaps being disposed in each of said container constituents, and each are configured to at least secure said top foam discs and bottom foam discs in place.

9. The device of claim 7, in which said at least two top foam discs and said at least two bottom foam discs comprises at least one of, a polyurethane (PU) material and a polyethylene (PE) material.

10. The device of claim 8, in which each of said endcaps comprises a removeable endcap that is configured to allow access to the top foam discs or bottom foam discs for cleaning.

11. The device of claim 10, in which each of said endcaps further comprises a center hole portion that is configured to allow an earbud to pass.

12. The device of claim 11, in which each of said endcaps further comprises a threaded cylindrical endcap segment.

13. The device of claim 12, in which said container pouch implement is made of, at least one of, a polyester, a cotton, and a vinyl fabric material having various sizes and shapes.

14. The device of claim 12, in which said container pouch implement comprises at least a tightknit mesh pouch, wherein said container pouch implement in use is configured to be operable for, at least one of, preventing an accidental loss of an earbud, providing a clean and contained storing environment for earbuds, reducing a risk of exposing earbuds to dirt, grime and other undesirable elements, preventing exposure of earbuds to germs and bacteria of an open environment, and protecting earbuds users from a common source of ear infection.

15. The device of claim 12, in which said tapered stem portion and said attachment stem portion comprises at least one of, a polyvinyl chloride (PVC) material and a high-density polyethylene (HDPE) material in various sizes and shapes.

16. A device consisting of:

a container pouch implement, wherein said container pouch implement is configured to be operable for storing an earphone or an earbud paraphernalia, in which said container pouch implement comprises a closed end portion and an open end portion, wherein said open end portion comprises a hem segment that is configured to receive a drawstring mechanism, and in which said container pouch implement further comprises an interior hem segment, wherein said interior hem is configured to seal said closed end portion;

at least two container constituent, wherein each of said at least two container constituents is configured to receive an earbud, in which each of said at least two container constituents comprises a concave channel segment that is configured to receive an earbud plug;

a tapered stem portion, wherein said tapered stem portion is configured to connect said at least two container constituents, and wherein said tapered stem portion is further configured to accept an earbud wire or cord;

an attachment stem portion, wherein said attachment stem portion is configured to engage said at least two container constituents with said container pouch implement, and wherein said interior hem segment is further configured to engage said attachment stem portion;

a drawstring mechanism disposed in said hem segment, wherein said drawstring mechanism is configured to seal said open end portion of said container pouch implement;

at least two top foam discs, each of said at least two top foam discs being disposed in each of said container constituents, and each of said at least two top foam discs having cut holes, wherein said cut holes are configured to allow an earbud to slip in;

at least two bottom foam discs, each of said at least two bottom foam discs being disposed in each of said container constituents, and each of said at least two bottom foam discs having cut holes; and at least two endcaps, wherein each of said at least two endcaps being disposed in each of said container constituents, in which each of said endcaps comprises a removeable endcap that is configured to allow access to the top foam discs or bottom foam discs for cleaning, and in which each of said endcaps further comprises a center hole portion that is configured to allow an earbud to pass.

* * * * *